United States Patent [19]

Iwata

[11] Patent Number: 4,632,646

[45] **Date of Patent: * Dec. 30, 1986**

[54] SQUEEZE PUMP

[75] Inventor: Noboru Iwata, Gifu, Japan

[73] Assignee: Daiichi Engineering Co., Ltd., Gifu, Japan

[ * ] Notice: The portion of the term of this patent subsequent to Jan. 8, 2002 has been disclaimed.

[21] Appl. No.: 628,705

[22] Filed: Jul. 9, 1984

Related U.S. Application Data

[63] Continuation-in-part of Ser. No. 440,214, Aug. 2, 1982, Pat. No. 4,492,538.

[30] Foreign Application Priority Data

| | | | |
|---|---|---|---|
| Dec. 13, 1980 | [JP] | Japan | 55-176235 |
| Mar. 25, 1981 | [JP] | Japan | 56-44490 |
| Jul. 6, 1981 | [JP] | Japan | 56-105354 |
| Jul. 23, 1981 | [JP] | Japan | 56-116270 |
| Jul. 30, 1982 | [WO] | PCT Int'l Appl. | PCT/JP81/00364 |

[51] Int. Cl.[4] ..... F04B 43/12

[52] U.S. Cl. ..... 417/477; 417/900

[58] Field of Search ..... 417/477, 476, 900

[56] References Cited

U.S. PATENT DOCUMENTS

| | | | |
|---|---|---|---|
| 2,831,437 | 4/1958 | Cromwell et al. | 417/477 |
| 3,255,483 | 5/1966 | Swan | 138/122 |
| 3,421,447 | 1/1969 | Jackson et al. | 417/477 |
| 3,790,313 | 2/1974 | Magerle | 417/477 |
| 4,492,538 | 1/1985 | Iwata | 417/477 |

*Primary Examiner*—John J. Vrablik

*Attorney, Agent, or Firm*—Jordan and Hamburg

[57] ABSTRACT

A squeeze pump adapted to transfer a slurry with solid materials comprises a resilient tube at least partly curved along an imaginary circle, a rotary arbor situated in the center of the imaginary circle so that the curved portion of the resilient tube is equidistantly away from the rotary arbor, the rotary arbor being adapted to be rotated by power means, and at least one pair of pressing devices connected to the arbor for pressing the resilient tube. Each pressing device includes a support shaft extending outwardly from the arbor toward the resilient tube, and a presser roll freely and rotationally connected to the support shaft. The presser roll is formed of a main body and a tapered head. The two pressing devices face each other so that the innermost planes of the main bodies always facing each other are parallel and are spaced apart at a distance about twice as great as the thickness of the wall of the resilient tube. When the rotary arbor is rotated, the presser rolls gradually nip the tube from a portion close to the rotary arbor toward outwardly by means of the tapered head so that the solid materials contained in the slurry are pushed gradually away from the tapered heads to prevent the solid materials from being nipped by the main bodies, and then press the tube completely by means of the main bodies.

4 Claims, 24 Drawing Figures

FIG. 15a
PRIOR ART
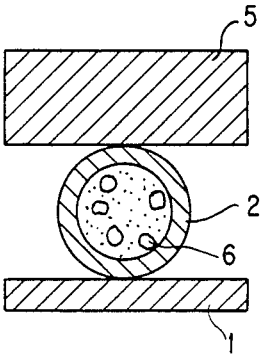
FIG. 15b
PRIOR ART
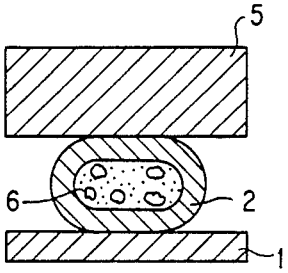
FIG. 15c
PRIOR ART
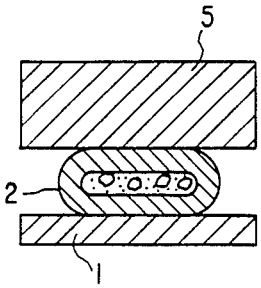
FIG. 15d PRIOR ART
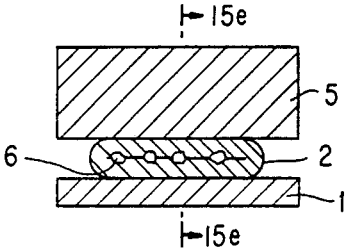
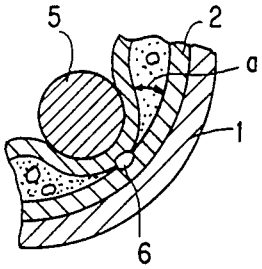
FIG. 15e
PRIOR ART

SQUEEZE PUMP

CROSS-REFERENCE TO RELATED APPLICATION

This is a continuation-in-part application of Ser. No. 440,214 filed on Aug. 2, 1982, now U.S. Pat. No. 4,492,538.

BACKGROUND OF THE INVENTION AND DESCRIPTION OF THE RELATED ART

This invention relates to a squeeze pump in which a resilient tube disposed arcuately in a pump casing is pressed by presser rolls moved along the resilient tube, the presser rolls being freely rotated about their axes, to thereby continuously transfer slurry contained in the tube.

The squeeze pump, known in the art as shown in FIG. 1, comprises a resilient tube 2 bent arcuately and placed along an inner periphery of a pump casing 1, and a plurality of presser rolls 5 carried by a rotary arm 4 parallel to a rotary arbor 3 and integral with the rotary arm 4. Upon rotation of the rotary arm 4 in the direction of the arrow marked in FIG. 1, the respective presser rolls 5 roll on the resilient tube 2, wherein the tube 2 is clamped between the rolls 5 and the inner periphery of the pump casing 1, for transferring slurry in the tube 2.

In particular, when concrete slurry including aggregates 6 therein is transferred by the conventional squeeze pump as shown in FIG. 1, the tube 2 is gradually pressed by the presser roll 5 against the inner periphery of the pump casing 1. Pressing procedure of the tube 2 by means of the roll 5 is shown in FIGS. 15(*a*)–15(*d*).

In FIG. 15(*a*), the roll 5 has begun to press the tube 2, in which the tube 2 is still round. As the rotary arbor 3 rotates, the roll 5 presses the tube 2 against the casing 1 as shown in FIG. 15(*b*), wherein the slurry and aggregates inside the tube 2 can still move freely. When the rotary arbor 3 further rotates, aggregates 6 are caught inside the tube 2 as shown in FIG. 15(*c*). Since one side of the tube 2 adjacent to the roll 5 is gradually pressed or moved toward the opposite side of the tube 2 adjacent to the casing 1, aggregates in the slurry located adjacent to the casing are not pushed in any direction. Therefore, although some aggregates may still escape from being caught by inner sides of the tube 2, at least some aggregates are caught as shown in FIG. 15(*c*). In this situation, when the roll 5 further rotates, aggregates stick in the tube 2 as shown in FIG. 15(*d*).

Further, when the roll 5 is moved along the inner periphery of the casing 1, some aggregates may be caught inside the tube because an angle a is not wide enough to push aggregates outwardly as shown in FIG. 15(*e*). Therefore, aggregates will further stick in the tube.

As stated above, if a conventional squeeze pump is used to transfer the concrete slurry with aggregates, aggregates will be caught or nipped inside the tube. Aggregates may even stick into the tube. Consequently, the tube may be easily worn out or torn. The conventional squeeze pump is not suitable to transfer concrete slurry.

Further, in this known type of the squeeze pump, since the resilient tube 2 is pressed by the presser rolls 5 onto the inner peripheral surface of the pump casing 1, such peripheral surface must be accurately arcuate for stably clamping the resilient tube 2 between the presser rolls 5 and the inner peripheral surface of the pump casing 1. Moreover, to prevent the damage of the resilient tube 2, such peripheral surface must be ground to a smooth surface, while the rotary shaft 3 must be centered accurately in the pump casing 1 so that the presser rolls 5 may accurately follow the inner peripheral surface of the pump casing 1.

On the other hand, when the resilient tube 2 is mounted in the casing 1 in an arcuate form along the arcuate surface, the tube 2 may be elliptical in cross-section and moreover the tube 2 is pressed by the rolls 5 in a direction to further flatten the ellipsis. As a result, the tube 2 may be restored simply to an elliptical cross-section after the presser rolls 5 have passed thereon. Thus, the tube 2 may be deformed permanently to an elliptical cross-section with prolonged use resulting in the reduction of the slurry quantity to be transferred. In addition thereto, since the tube 2 is pressed onto the inner peripheral surface of the pump casing 1, the tube 2 tends to be elongated slightly and heated due to strong friction caused by pressure contact between the tube 2 and the peripheral surface, thus causing premature wear of the tube 2.

This invention has been made to overcome these deficiencies and has an object to provide a squeeze pump wherein the slurry is transferred effectively, the resilient tube is improved in durability by preventing wear thereof and manufacture is facilitated.

It is another object of the present invention to provide a squeeze pump wherein a slurry with solid materials can be effectively transferred without wear of the tube.

It is another object of the present invention to provide a squeeze pump wherein the tube has improved restorability after pressing, resulting in improved efficiency of slurry suction by the resilient tube.

It is another object of the present invention to provide a squeeze pump wherein the inner peripheral surface of the pump casing need not have a ground finish and the rotary arbor may be centered roughtly, resulting in the reduced manufacture costs of the overall device.

It is another object of the present invention to provide a squeeze pump wherein a rib is mounted at the center of the inner peripheral surface of the pump casing for setting the radius of bend of the resilient tube, whereby the mounting of the tube within the pump casing is facilitated.

It is another object of the present invention to provide a squeeze pump wherein tube fatigue to be caused at the start and termination of clamping of the resilient tube is reduced.

It is another object of the present invention to provide a squeeze pump wherein the solid materials contained in the slurry do not encroach on the inner surface of the tube during pressing of the tube by the presser rolls to prevent the wear of the tube.

It is yet another object of the present invention to provide a squeeze pump wherein the presser rolls positively press the tube without slipping.

SUMMARY OF THE INVENTION

A squeeze pump in accordance with the present invention is adapted to transfer a slurry with solid materials, such as a concrete slurry with aggregates therein. The squeeze pump comprises a resilient tube at least partly curved along an imaginary circle, the slurry with solid materails passing through the tube, a rotary arbor situated in the center of the imaginary circle so that the curved portion of the resilient tube is equidistantly away from the rotary arbor, the rotary arbor being adapted to be rotated by power means, and at least one pair of means for pressing the resilient tube connected to the arbor. Each pressing means includes a support shaft extending outwardly from the arbor toward the resilient tube, and a presser roll freely and rotationally connected to the support shaft and having a main body and a tapered head. The two pressing means face each other so that the innermost planes of the main bodies of the two presser rolls always facing each other are parallel and are spaced apart at a distance about twice as great as the thickness of the wall of the resilient tube.

When the rotary arbor is rotated, at first the tapered heads of the presser rolls gradually nip the tube from the inner portion toward outwardly so that the solid materials contained in the slurry are pushed gradually away from the tapered heads to prevent the solid materials from being nipped by the main bodies, and then the main bodies of the presser rolls nip and press the tube completely. Consequently, the solid materials in the slurry are not substantially nipped by the main bodies of the presser rolls to provide a smooth transfer of the slurry with solid materials by means of the main bodies of the presser rolls without causing wear of the resilient tube.

The support shafts of the pressing means are spaced apart on the rotary arbor so that the presser rolls on the support shafts nip and press the resilient tube equally from two sides of the tube to provide a wide nipping angle defined between two inner surfaces of the resilient tube pressed by the pressing means. Consequently, the solid materials in the slurry are substantially prevented from being nipped between the presser rolls while the slurry is transferred in the resilient tube by the presser rolls. Preferably, the resilient tube is situated along an inside of a semi-circular casing so that the resilient tube is partly curved easily along the imaginary circle.

The squeeze pump of the present invention further comprises at least one auxiliary support shaft connected to the arbor, a restoration roll rotationally connected to the auxiliary support shaft, and a rib situated inside the casing. The distance between the rib and the restoration roll is substantially the same as the outer diameter of the undistorted resilient tube. Therefore, after the tube is pressed by the presser rolls, the tube is urged by the restoration roll with an aid of the rib to return to its undistorted configuration.

The resilient tube may include a plurality of grooves on the outer periphery thereof. Consequently, the resilient tube can be gradually bent along the configuration of the presser rolls and is thereafter pressed by the presser rolls to thereby provide a widest nipping angle.

According to the present invention, the resilient tube is pressed by the presser rolls from two sides, and the tube disposed in the pump casing is restored to the original circular cross-sectional shape by means of the restoration rolls and the rib in the casing. The resilient tube is therefore prevented from being deformed permanently into an elliptical cross-section to assure a sufficient quantity of the slurry to be transferred. Further, since the resilient tube is not pressed between the presser roll and the pump casing, the tube does not tend to be stretched or elongated from the center towards the inner periphery of the pump casing, resulting in the increased durability of the resilient tube.

In addition, since the tube is provided with peripheral grooves, the tube may have improved flexibility. Therefore, when the presser rolls engage the grooved peripheral surface of the tube, the grooved surface is bent acutely, so that the nipping angle relative to the inner wall of the tube is increased. Thus, the solid materials in the slurry may not be easily nipped between the tube portions pressed by the presser rolls, and the tube may not be worn out promptly and hence may have improved durability. Moreover, since the resilient tube is pressed from both sides by a pair of presser rolls, the nipping angle may be made largest. Thus, the capacity between the rolls may be increased for effective transfer of the slurry. In addition, since the tube is provided with peripheral grooves, the radius of the curve of the tube in the pump casing may be set to a lower value, so that the pump casing may have a reduced diameter.

The presser rolls may be made frusto-conical in cross-section with the diameter increasing towards radially outwardly thereof so that the rolls may not slip on the tube when the tube is pressed by the presser rolls and the tube may be pressed reliably by the presser rolls.

BRIEF DESCRIPTION OF THE DRAWINGS

FIGS. 15(*a*)–15(*d*) are sectional explanatory views of the conventional squeeze pump showing the squeezing procedure of the conventional pump; and FIG. 15(*e*) is a section view taken along line 15(*e*)—15(*e*) in FIG. 15(*d*).

DETAILED DESCRIPTION OF PREFERRED EMBODIMENTS

Figure 1:
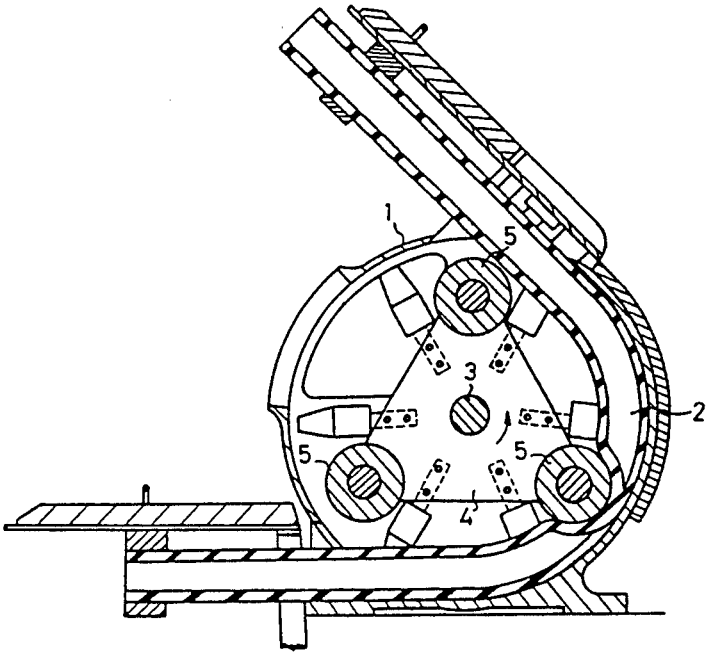
FIG. 1 PRIOR ART
FIG. 1 is a sectional view showing an example of the conventional squeeze pump.
Figure 2:
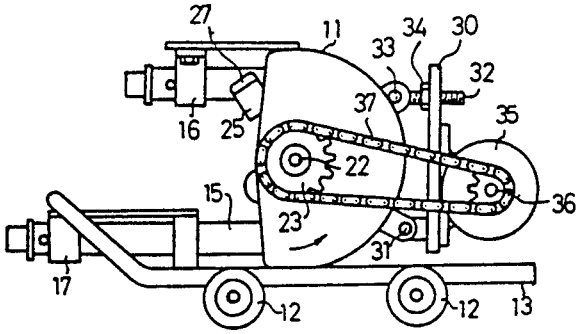
FIG. 2 is a front view showing a squeeze pump embodying the present invention.
Figure 3:
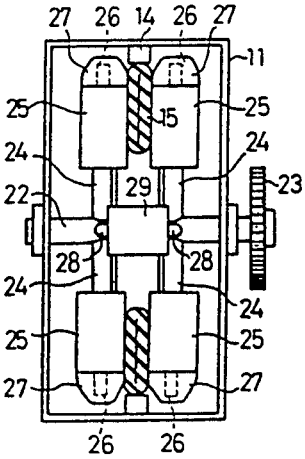
FIG. 3 is a partially enlarged side elevation thereof.

Referring to FIGS. 2 to 8 which illustrate preferred embodiments of the present invention, the numeral 11 denotes a substantially semicylindrical pump casing secured on a base table 13 provided with wheels 12. The numeral 14 denotes an arcuate rib secured in the center of the arcuate inner periphery of the pump casing 11 (FIG. 3). A resilient tube 15 is arcuately bent and is disposed along the inner surface of the rib 14. The resilient tube 15 has straight end portions extending forwardly of the pump casing 11, and one end being carried by a support fixture 16 secured to the upper end of the outer surface of the pump casing 11 and the other end being carried by another support fixture 17 secured on the base table 13.

The numeral 18 denotes a large number of peripheral grooves on the outer surface of the tube 15 which are located in a curved section, not the straight end sections of the tube 15. These grooves 18 are square in cross-section with width about 3 to 10 mm and depth about 5 to 8 mm and are provided at intervals of 10 to 25 mm. The numeral 19 denotes a reinforcing cloth layer composed of a plurality of reinforcing cloths 20 embedded in the tube 15 and rubber sheets 21 with thickness of about 1.5 to 4 mm disposed between the reinforcing cloths 20 to prevent these cloths from peeling from one another.

The resilient tube 15 of the present embodiment has an inside diameter of about 100 to 150 mm and a relatively large thickness of about 20 to 38 mm. The reinforcing cloth layer 19 is offset inwardly about one-third the tube thickness from the tube surface.

Figure 6:
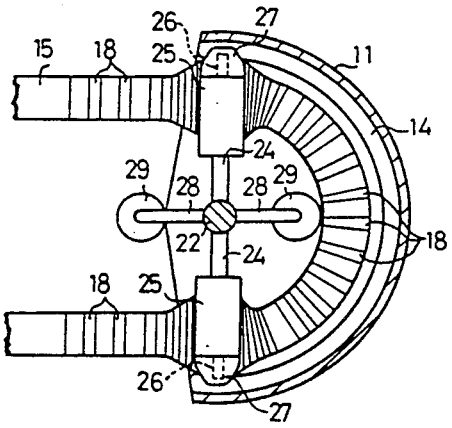
FIG. 6 is a front view showing the tube clamped completely by presser rolls.

The numeral 22 denotes a rotary arbor mounted between two side plates of the pump casing 11 as shown in FIGS. 3 and 6. A sprocket 23 is mounted at one end of the arbor 22. The numeral 24 denotes a pair of support shafts mounted on the arbor 22 at right angles therewith to extend outwardly from the arbor 22. The support shafts 24 are slightly spaced apart from each other.

The numeral 25 denotes metallic presser rolls freely and rotationally mounted on the extreme ends of the support shafts 24. These presser rolls 25 are rotated about the rotary arbor 22 as center to roll on the outer surface of the tube 15 while clamping the tube 15 from both sides. The presser roll 25 is columnar in shape and has the same thickness from the base end to the foremost end. The numeral 26 denotes a stem projectingly mounted in the center of the foremost end of the presser roll 25. The numeral 27 denotes a resilient or a tapered head made from e.g. rubber, which is fixed to the foremost end of the presser roll 25 by means of the stem 26. The tapered head 27 may be rotated together with the presser roll 25.

The tapered heads 27 are positioned so that when the tube 15 is clamped, the front ends of the tapered heads at first slightly contact with the outer periphery of the tube 15 and gradually clamp the same, and then the presser rolls 25 completely clamp the tube 15. The tapered head 27 is machined smoothly so as to have no projecting portions.

The numeral 28 denotes a pair of auxiliary support shafts secured to the rotary arbor 22 to be displaced 90° away from the support shafts 24, and the numeral 29 denotes a pair of restoration rolls mounted on the support shafts 28 for rolling freely. The function of these restoration rolls 29 is to act from the inner side on the resilient tube 15 which has been flattened by the presser rolls 25 to restore to its original cylindrical shape and to prevent the tube 15 from moving towards the center of the pump casing 11.

The numeral 30 denotes a motor mounting plate pivotally mounted at the lower portion thereof to the lower rear surface of the pump casing 11 by means of a shaft 31 (FIG. 2) for tiltable back and forth movement about the shaft 31. The numeral 32 denotes a bolt pivotally mounted at one end thereof to the rear upper surface of the casing 11 by means of a shaft 33, and having a foremost part passing through the upper part of the motor mounting plate 30. The numeral 34 denotes a nut threadedly engaged the bolt 32 and abuting on the front face of the motor mounting plate 30.

The numeral 35 denotes a motor secured to the rear surface of the motor mounting plate 30. An endless chain 37 is mounted between a sprocket 36 connected to the motor 35 and the sprocket 23 mounted on the rotary arbor 22.

Hence, rearward tilting of the motor 35 about the pivot 31 is restrained by the chain 37 while forward tilting thereof is restrained by the nut 34. The chain 37 is kept tight beweeen the sprockets 23 and 36 by adjusting the nut 34.

In the squeeze pump mentioned above, when the arbor 22 is rotated by the motor 35 in the direction of the arrow mark, a pair of presser rolls 25 starts to contact with and rolls on both transverse sides of the tube 15 for pinching the tube 15 therebetween. The procedure of pressing the tube 15 by means of the presser rolls 25 is shown in FIGS. 4(*a*)–4(*c*).

Figure 4A:
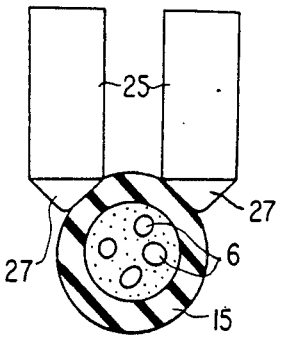
FIGS. 4(*a*)–4(*c*) are side elevational views showing the procedure whereby the resilient tube is pressed by the presser rolls.
Figure 4B:
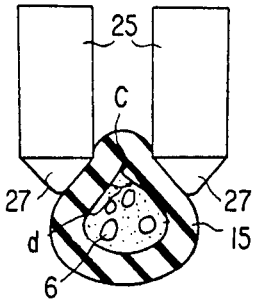
Figure 4C:
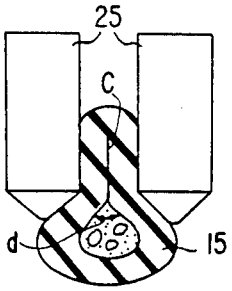
Figure 5:
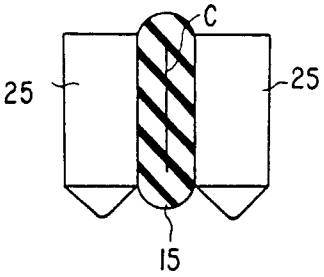
FIG. 5 is a side elevation view in which the resilient tube is completely pressed by the presser rolls.

In FIG. 4(*a*), the presser rolls 25 start to nip the tube 15, in which the tube 15 is still round. When the rotary arbor 22 rotates slightly, as shown in FIG. 4(*b*), the tapered heads 27 of the rolls 25 nip one side of the tube 15, so that a closing portion c is established at the side of the tube. As the rotary arbor 22 rotates further as shown in FIG. 4(*c*), the closing portion c increases, and finally the tube 15 is completely pressed by the presser rolls 25 (FIG. 5). In other words, the tube 15 is gradually pressed from one side to the other side by increasing the closing portion c.

As shown in FIGS. 4(*b*) and 4(*c*), when the tube 15 is nipped by the presser rolls 25, a nipping angle d is defined by the tapered heads 27. The nipping angle d is kept relatively wide while the tube 15 is continuously pressed, i.e. the closing portion c is increasing. Therefore, in case a concrete slurry including aggregates 6 is transferred by the pump of the invention, the aggregates 6 are pushed outwardly by the tapered heads 27 from one side to the other side as the tube 15 is gradually pressed by the presser rolls 25. Namely, the aggregates 6 escape from the closing portion c when the tube 15 is pressed. The aggregates 6 are not substantially nipped between the presser rolls 25.

Figure 7:
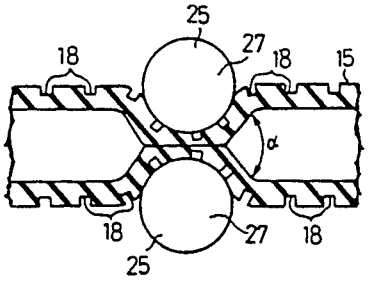
FIG. 7 is a cross-sectional view in FIG. 6 showing the tube being clamped.
Figure 8:
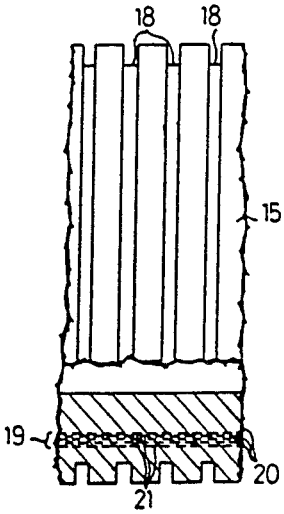
FIG. 8 is a partially sectional view of the enlarged resilient tube.

After the tube 15 is completely nipped by the presser rolls 25 as shown in FIG. 5, the presser rolls 25 continuously roll along the tube 15. A nipping angle e is defined between the inner surfaces of the tube 15 pressed by the rolls 25, as shown in FIG. 7. Since the nipping angle e is relatively wide, when the tube 15 is pressed by the rotating rolls 25, aggregates are not caught inside the tube 15. The aggregates are generally pushed outwardly by means of the rolls 25. Therefore, the concrete slurry with aggregates is smoothly transferred by the presser rolls 25 without being nipped between the presser rolls.

The other pair of presser rolls 25 displaced 180° from the aforesaid rolls 25 is then moved towards the lower forward portion of the tube 15 and starts to pinch the tube 15 in the same manner as mentioned above. The slurry in the tube 15 may thus be delivered continuously in the rotational direction of the presser rolls 25.

Figure 9A:
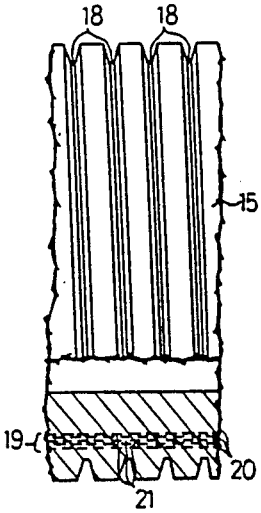
FIGS. 9(*a*), (*b*) are partially sectional enlarged views showing modified tubes.
Figure 9B:
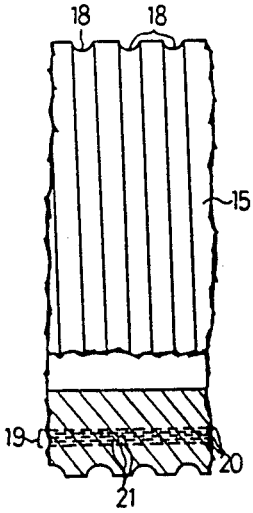

The peripheral grooves 18 on the outer surface of the tube 15 in the preceding embodiment may be replaced by a single spiral groove. The grooves 18 may be shaped in square in cross-section with the bottom portions being slightly reduced in width (FIG. 9*a*) or in semi-circular in cross-section (FIG. 9*b*).

Figure 10:
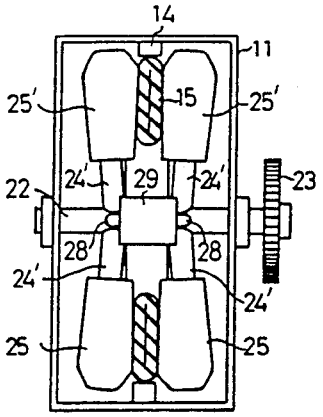
FIG. 10 is a side elevation of a squeeze pump having tapered presser rolls.
Figure 11:
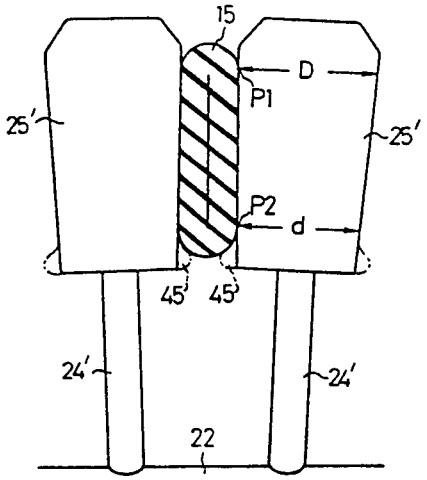
FIG. 11 is an enlarged view of the presser rolls of FIG. 10.

The presser roll 25 need not be columnar but may also be frusto-conical as shown in FIGS. 10 and 11. In the present embodiment, the presser rolls 25' are frusto-conical in cross-section with the diameters thereof increasing radially outwardly as shown in FIGS. 10 and 11, and the support shafts 24' are secured to the arbor 22 with a slight tilt towards outside. The rolls 25' have opposed sides parallel to each other so that the tube 15 may be clamped flat between these opposed sides. The diameter D of the roll 25' at a radially outer point P1 of the presser roll 25' clamping the radially outer portion of the tube 15 and the diameter d of the roll 25' at a radially inner point P2 of the roll 25' clamping the radially inner portion of the tube 15, wherein D>d, are determined to satisfy the relation $$n2\pi\frac{D}{2} = 2\pi R$$

and hence $$D = \frac{2R}{n}, \text{ and}$$

$$n2\pi\frac{d}{2} = 2\pi r$$

and hence $$d = \frac{2r}{n},$$

wherein R denotes the distance between the central axis of the rotary arbor 22 and the point P1, r denotes the distance between the central axis of the rotary arbor 22 and the point P2, wherein R>r, and n denotes rotational number that the presser roll 25' has rotated about its own axis without slipping during one complete revolution of the rotary arbor 22.

Accordingly, there is no slip of the radially outer point P1 of the roll 25' relative to the tube 15 due to the difference $2\pi(R-r)$ between the distance $2\pi R$ traversed by the point P1 and the distance $2\pi r$ traversed by the point P2 during one complete revolution of the roll 25' about the rotary arbor 22, so that the roll 25' in its entirety may pinch the tube 15 positively and consecutively.

On the other hand, should the diameter of each presser roll 25 be the same from the radially inner end to the radially outer end, i.e., the presser roll 25 is cylindrical, there exists a difference $2\pi(R-r)$ between the distances $2\pi R$, $2\pi r$ traversed by the points P1 and P2 of each roll 25. This difference may be compensated as a slip of the radially outer end portion of the presser roll 25 relative to the tube 15.

In the embodiment as shown in FIGS. 10, 11, to prevent the tube 15 from moving towards the rotary arbor 22 while the pair of rolls 25' rolls on the tube 15 to pinch the same, flange portions 45 may be provided to the radially inner portions of the presser rolls 25' as indicated by double-dotted chain line in FIG. 11. The opposing surfaces of the rolls 25' at the radially inner portion is the narrowest so that the tube 15 tends to be extruded outwards away from the inner portion. Alternatively, the support shafts 24' may be secured at right angles to the arbor 22 and bent obliquely at intermediate portions for obliquely carrying the presser rolls 25'.

It is to be noted that the present invention is not restricted to the above embodiments but may be executed in any of the following modes.

Figure 12:
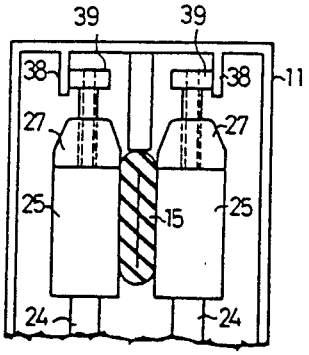
FIG. 12 is a partially enlarged side elevation showing support means for the end parts of the presser rolls.

(a) A pair of support rails 38 are projected integrally from the inner peripheral surface of the pump casing 11, as shown in FIG. 12, and a pair of support rolls 39 are provided at the ends of the rolls 25 for rolling on and contacting with the inner sides of the support rails 38. In this arrangement, the rolls 25 may be immovably carried in the lateral direction at the foremost parts thereof so that the tube 15 may be securely pinched by the rolls 25.

Figures 13, 13A:
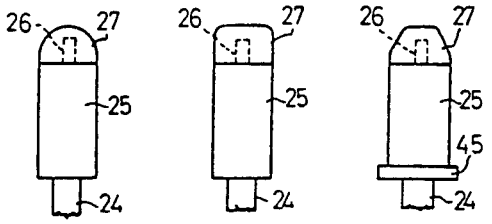
FIGS. 13(*a*) to (*c*) are front views showing modified presser rolls.
Figure 14:
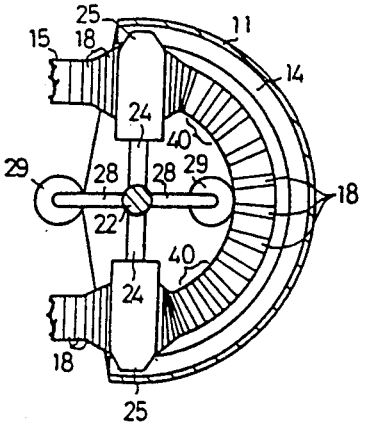
FIG. 14 is a front view showing a modified resilient tube.

(b) The foremost end of the tapered head 27 may be semispherical as shown in FIG. 13*a;* the protuberant end portion of the tapered head 27 may be rounded as shown in FIG. 13*b;* or a flange 45 may be provided at the radially inner end of the presser roll 25 for holding the inner periphery of the tube 15 as shown in FIG. 13*c*.

(c) The peripheral grooves 18 of the tube 15 disposed in upper and lower side zones (indicated at 40) are spaced apart one another closer than in the other zones. In this arrangement, when the tube 15 is clamped by the presser rolls 25, the tube 15 is not liable to be flexed at the zones 40 and may be positively guided along the inner periphery of the pump casing 11.

While the invention is explained with reference to the specific embodiments of the invention, the description is illustrative and the invention is limited by the appended claims.

What is claimed is:

1. A squeeze pump adapted to transfer a slurry with solid materials therein, comprising:

a resilient tube at least partly curved along an imaginary circle, the slurry with solid materials being adapted to be transferred through the tube, a semi-circular casing, said resilient tube being situated along the inside of the semi-circular casing so that the resilient tube is partly curved along the imaginary circle, said semi-circular casing having two support rails situated in the inner periphery of the casing parallel to the resilient tube at both sides thereof, a rotary arbor situated in the center of the imaginary circle so that the curved portion of the resilient tube is equidistantly away from the rotary arbor, said rotary arbor being adapted to be rotated by power means, and at least one pair of means connected to the arbor for pressing the resilient tube, each pressing means including a support shaft extending outwardly from the arbor toward the resilient tube, a presser roll freely rotationally connected to the support shaft and having a main body and a tapered head, the two support shafts of the pressing means being spaced apart on the rotary arbor to allow the two pressing means to face each other so that the innermost planes of the main bodies of the respective presser rolls always facing each other are parallel and are spaced apart at a distance about twice as great as the thickness of the wall of the resilient tube to allow the presser rolls on the support shafts to nip and press the resilient tube equally from two sides of the tube to provide a wide nipping angle defined between two inner surfaces of the resilient tube pressed by the pressing means, and a support roll rotationally connected to the outer end of each presser roll so that when the presser rolls press the tube, the support rolls engage the support rails to cause the tube to be pressed evenly by the presser rolls, said presser rolls, when the rotary arbor is rotated, gradually nipping the tube from a portion close to the rotary arbor to a portion away from the rotary arbor across the entire width of the tube by means of the tapered heads so that the solid materials contained in the slurry are pushed gradually away from the tapered heads to prevent the solid materials from being nipped by the main bodies and then pressing the tube completely by means of the main bodies, whereby the solid materials in the slurry are not substantially nipped by the main bodies of the presser rolls to provide a smooth transfer of the slurry with solid materials by means of the main bodies of the presser rolls.

2. A squeeze pump according to claim 1, further comprising at least one auxiliary support shaft connected to the arbor, a restoration roll rotationally connected to the auxiliary support shaft, and a rib situated inside the casing, said resilient tube being situated inside the rib and adapted to be pressed against the rib by means of the restoration roll, the distance between the rib and the restoration roll being substantially the same as the outer diameter of the undistorted resilient tube so that after the tube is pressed by the presser rolls, the tube is urged by the restoration roll to return to its undistorted configuration.

3. A squeeze pump according to claim 2, in which said resilient tube includes a plurality of grooves on the outer periphery thereof so that the resilient tube can be gradually bent along the configuration of the presser rolls and is thereafter pressed by the presser rolls to thereby provide a widest nipping angle when the tube is pressed by the presser rolls.

4. A squeeze pump according to claim 3, in which said grooves are formed by a single spiral depression on the outer periphery of the resilient tube.

* * * * *